United States Patent [19]

Pearson

[11] 4,088,313

[45] May 9, 1978

[54] SPRING ACTUATED WOODWORKING CLAMP

[76] Inventor: Hilding A. Pearson, 8150 SW. Peters Rd., Portland, Oreg. 97223

[21] Appl. No.: 788,739

[22] Filed: Apr. 19, 1977

[51] Int. Cl.[2] ..... B25B 5/16

[52] U.S. Cl. ..... 269/88; 269/166; 269/254 R; 269/279

[58] Field of Search ..... 269/88, 166, 254 R, 269/152–153, 237–238, 279–284

[56] References Cited

U.S. PATENT DOCUMENTS

| | | | |
|---|---|---|---|
| 397,470 | 2/1889 | Remsen | 269/280 |
| 2,040,669 | 5/1936 | Odmark | 269/166 |

*Primary Examiner*—Robert C. Watson

*Attorney, Agent, or Firm*—Lee R. Schermerhorn

[57] ABSTRACT

A first clamp jaw extends in prolongation of one clamping nose of a spring actuated pliers type clamp. A rod extends perpendicularly from the back side of the other clamping nose of the pliers type clamp. A second clamp jaw is slidable on said rod to receive workpieces of widely varying thicknesses between said two jaws.

1 Claim, 3 Drawing Figures

FIG. 1
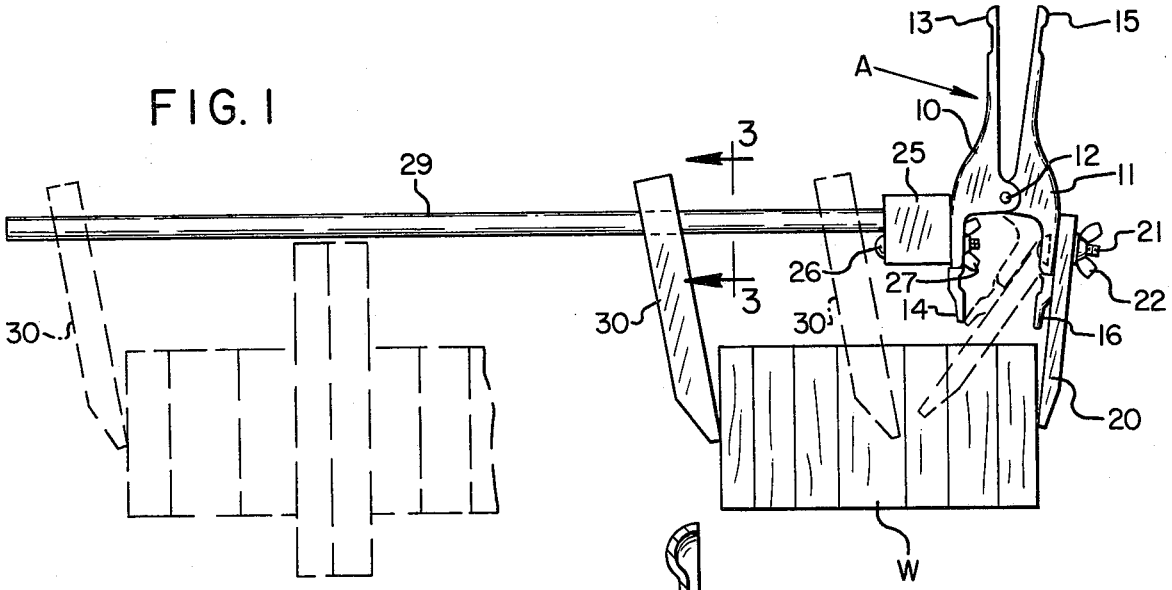
FIG. 2
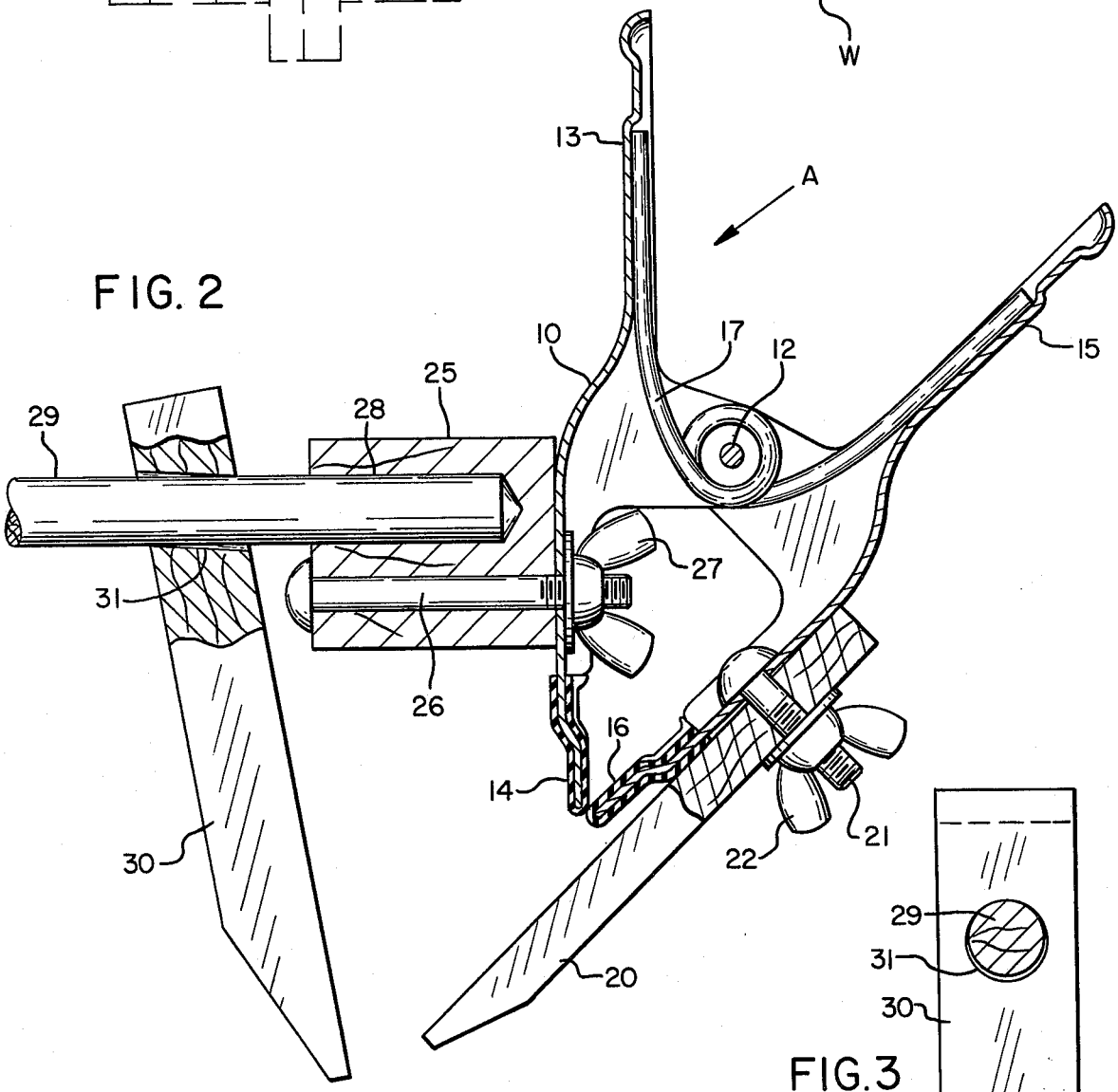
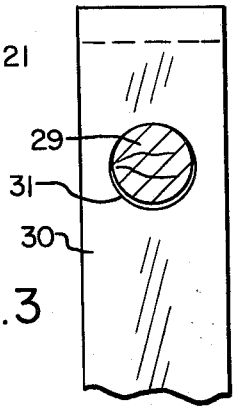
FIG. 3

SPRING ACTUATED WOODWORKING CLAMP

BACKGROUND OF THE INVENTION

This invention relates to a spring actuated woodworking clamp for clamping work pieces of widely varying thicknesses, particularly for gluing parts together.

For gluing it is often desired to use a spring actuated clamp which will maintain a constant pressure on the workpiece by the action of a spring over a period of time while the glue is setting. It is a great convenience to have a single clamp which is quickly adjustable through a wide range to receive workpieces which may vary in thickness from perhaps a few inches to several feet.

Clamps heretofore devised for such purpose have been excessively complicated and expensive, making them impractical where a number of clamps are necessary.

Objects of the present invention are therefor to provide an improved spring operated clamp, to provide a clamp of the type described which is quickly adjustable to workpieces of widely varying thicknesses, and to provide a clamp for the present purpose which is a simple and inexpensive adaptation of a known type of spring actuated pliers type clamp.

SUMMARY OF THE INVENTION

In the present construction a first clamp jaw extends in prolongation of one clamping nose of a spring actuated pliers type clamp. A rod extends perpendicularily from the back side of the other clamping nose of the pliers type clamp. A second clamp jaw is slidable on said rod to receive workpieces of widely varying thicknesses between said two jaws.

Another advantage of the present clamp is that the mentioned rod and clamp jaws may be mounted so as to be readily removable from the pliers type clamp, leaving the latter available for use on relatively thin workpieces which do not exceed the grasp of the plier type clamp. This not only greatly extends the range of usefullness of the pliers type clamp but also makes it unnecessary to stock a wide variety of clamps for workpieces of different dimensions.

The invention will be better understood and the foregoing and additional objects and advantages will become apparent from the following description of the preferred embodiment illustrated on the accompanying drawing. Various changes may be made in the details of construction and arrangement of parts and certain features may be used without others. All such modifications within the scope of the appended claims are included in the invention.

BRIEF DESCRIPTION OF THE DRAWING

FIG. 1 is a plan view showing the clamping action of the present clamp on workpieces of different thicknesses.

FIG. 2 is an enlarged view of a portion of FIG. 1 with parts in section and with the workpieces omitted.

FIG. 3 is view on the line 3—3 in FIG. 1.

DESCRIPTION OF THE PREFERRED EMBODIMENT

The invention is illustrated as an adaptation of a conventional spring actuated pliers type clamp A but the invention is not limited to such an adaptation. The parts may be constructed and arranged specifically for the present purpose without utilizing a pliers type clamp as such.

The pliers type clamp A comprises a pair of lever arms 10 and 11 pivotally joined together intermediate their ends by a pivot pin 12. Lever arm 10 has a handle end 13 and a nose end 14, and lever arm 11 has a handle end 15 and a nose end 16. A relatively stiff mouse trap type spring 17 presses the handle ends 13 and 15 apart causing the nose ends 14 and 16 to press against each other or against opposite sides of a relatively thin workpiece. The nose ends 14 and 16 are separated to receive a thin workpiece by squeezing together the handle ends 13 and 15.

According to the present invention a first jaw member 20 is mounted on nose end 16 in prolongation thereof by means of bolt 21 and nut 22. A block 25 is mounted on the back side of nose end 14 by means of a bolt 26 and nut 27. Block 25 contains a bore 28 in which is secured one end of a rod 29 extending approximately perpendicular to nose end 14 of the pliers type clamp.

A second jaw member 30 contains a bore 31 having a loose sliding fit on rod 29. Thus the jaw member 30 is quickly adjustable along rod 29 to receive a workpiece, or a plurality of workpieces, W of widely varying thicknesses between the two clamp jaws 20 and 30 as illustrated in solid and broken lines in FIG. 1. When jaw member 30 is not subject to clamping pressure it slides freely on rod 29 but when jaw member 30 is subject to eccentric loading by the interposition of workpieces W between jaw members 20 and 30 the bore 31 binds on rod 29 preventing jaw member 30 from sliding on the rod.

In order to apply the clamp all that is necessary is to squeeze the handle parts 13 and 15 together sufficiently to create the desired spring force and then slide jaw member 30 up against the workpiece and release the handle parts 13 and 15. Spring 17 then acts through jaw member 20 and workpiece W to apply eccentric loading to jaw member 30 causing the latter to securely grip rod 29.

Since the reaction of the spring force on jaw member 30 will cause jaw member 30 to deflect slightly in clockwise rotation it may be desirable to form bore 31 at a small angle from the perpendicular to jaw member 30 as shown in FIG. 2. This will compensate for any deflection of jaw member 30 under clamping pressure. In fact, it may be desirable to over-compensate for the deflection of jaw member 30 under clamping pressure so that the two jaw members 20 and 30 will be slightly convergent in operative position as are the nose ends 14 and 16 of the pliers type clamp A. This is the condition illustrated in FIGS. 1 and 2 by way of example.

By making the device as an adaptation of a conventional clamp, the pliers type clamp A is always available for clamping thin workpieces by simply removing nuts 22 and 27 and bolts 21 and 26.

What is claimed is:

1. In a spring actuated pliers type clamp for thin workpieces, said clamp having a pair of lever arms pivotally joined together intermediate their ends, said arms having convergent nose ends for clamping thin workpieces; the improvement comprising a first clamp jaw extending in prolongation of one of said nose ends and detachably secured to the back side thereof by a bolt, a block detachably secured to the back side of the other nose end by a bolt, a bore in said block perpendicular to said other nose end, a rod secured at one end in said bore and extending away from said other nose end, and a clamp jaw slidably mounted on said rod for clamping thick workpieces between said two jaws.

* * * * *